US010544711B1

(12) United States Patent
Mariuz et al.

(10) Patent No.: US 10,544,711 B1
(45) Date of Patent: Jan. 28, 2020

(54) SWITCHABLE ROCKER ARM AND ROLLER RETAINER THEREOF

(71) Applicant: DELPHI TECHNOLOGIES IP LIMITED, St. Michael (BB)

(72) Inventors: Robert M. Mariuz, Pittsford, NY (US); Hermes A. Fernandez, Pittsford, NY (US); Joseph M. West, Rochester, NY (US); Chad E. Uckermark, Warwick, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/123,421

(22) Filed: Sep. 6, 2018

(51) Int. Cl.

| | |
|---|---|
| ***F01L 1/18*** | (2006.01) |
| ***F01L 13/00*** | (2006.01) |
| *F01L 1/46* | (2006.01) |
| *F01L 1/24* | (2006.01) |

(52) U.S. Cl.
CPC ..... *F01L 1/181* (2013.01); *F01L 13/0015* (2013.01); *F01L 1/2405* (2013.01); *F01L 2001/186* (2013.01); *F01L 2001/467* (2013.01); *F01L 2105/02* (2013.01)

(58) Field of Classification Search
CPC ..... F01L 2001/186; F01L 2001/467; F01L 13/0005; F01L 2105/00; F01L 2105/02
USPC ..... 123/90.41, 90.44
See application file for complete search history.

(56) References Cited

U.S. PATENT DOCUMENTS

| | | | | |
|---|---|---|---|---|
| 6,668,779 | B2 | 12/2003 | Hendriksma et al. | |
| 7,305,951 | B2 | 12/2007 | Fernandez et al. | |
| 7,677,213 | B2 | 3/2010 | Deierlein | |
| 7,882,814 | B2 | 2/2011 | Spath et al. | |
| 7,926,455 | B2 | 4/2011 | Manther et al. | |
| 2007/0039573 | A1* | 2/2007 | Deierlein | F01L 1/185 123/52.1 |
| 2011/0265751 | A1* | 11/2011 | Becker | F01L 1/185 123/90.39 |
| 2012/0318216 | A1* | 12/2012 | Kudo | F01L 1/18 123/90.5 |
| 2012/0325168 | A1* | 12/2012 | Nitz | F01L 1/185 123/90.17 |
| 2015/0114330 | A1* | 4/2015 | Kwak | F01L 1/047 123/90.16 |
| 2017/0350282 | A1* | 12/2017 | Suzuki | F01L 1/18 |
| 2018/0306073 | A1* | 10/2018 | McCarthy, Jr. | F01L 1/146 |
| 2019/0186304 | A1* | 6/2019 | McCarthy, Jr. | F01L 1/2416 |

* cited by examiner

*Primary Examiner* — Jorge L Leon, Jr.
(74) *Attorney, Agent, or Firm* — Joshua M. Haines

(57) ABSTRACT

A rocker arm includes an outer arm having a first wall and a second wall and an inner arm which selectively pivots relative to the outer arm about a pivot shaft axis based on positioning of a lock pin. A lost motion spring includes an outer arm tang grounded to the outer arm and an inner arm tang grounded to the inner arm. A roller shaft is supported by the inner arm and extends toward the first wall. The roller shaft carries a roller which follows a camshaft. A roller retainer is carried by the roller shaft and is located between the roller and the first wall and includes a surface with which the inner arm tang is engaged to ground the lost motion spring to the inner arm through the roller shaft.

18 Claims, 6 Drawing Sheets

SWITCHABLE ROCKER ARM AND ROLLER RETAINER THEREOF

TECHNICAL FIELD OF INVENTION

The present invention relates to a rocker arm for valve train of an internal combustion engine; more particularly to a rocker arm with an inner arm which selectively pivots relative to an outer arm, and even more particularly to such a rocker arm which includes first and second rollers supported by the inner arm and which includes roller retainers which retain the first and second rollers and which ground lost motion springs to the inner arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency of the internal combustion engine.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second valve lift mode, that is greater than no lift. It should be noted that the second valve lift mode may provide one or both of increased lift magnitude and increased lift duration or one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm where the inner arm includes an inner arm follower which follows a first profile of a camshaft of the internal combustion engine and where the outer arm may include a pair of outer arm followers which follow respective second and third profiles of the camshaft. The follower of the inner arm and the followers of the outer arm may be either sliding surfaces or rollers and combinations thereof. The inner arm is movably connected to the outer arm and can be switched from a coupled state wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster which fits into a socket of the outer arm. A second end of the outer arm operates against an associated engine valve for opening and closing the valve by the rotation of an associated eccentric cam lobe acting on the follower of the inner arm. The inner arm is connected to the outer arm for pivotal movement about the outer arm's second end with the follower of the inner arm disposed between the first and second ends of the outer arm. Switching between the coupled state and the decoupled state is accomplished through a lock pin which is slidingly positioned in a lock pin bore of the outer arm. One end of the lock pin is moved into and out of engagement with the inner arm. Consequently, when the lock pin is engaged with the inner arm, the coupled state is achieved. Conversely, when the lock pin is not engaged with the inner arm, the decoupled state is achieved. As shown in U.S. Pat. No. 7,305,951 to Fernandez et al., the disclosure of which is hereby incorporated by reference in its entirety, the other end of the lock pin acts as a piston upon which pressurized oil is applied and vented to affect the position of the lock pin. Also as shown by Fernandez et al., oil is supplied to the lock pin via an oil supply bore which originates in the socket and breaks into the lock pin bore. Other known switchable rocker arms are disclosed in U.S. Pat. No. 7,677,213 to Deierlein and U.S. Pat. No. 7,926,455 to Manther et al. However, alternatives and variations are continually sought in any art.

SUMMARY OF THE INVENTION

Briefly described, and in accordance with the present invention, a rocker arm for transmitting rotational motion from a camshaft to opening and closing motion of a combustion valve in an internal combustion engine includes an outer arm having a first wall and a second wall spaced apart from the second wall such that a central opening is provided between the first wall and the second wall; an inner arm which selectively pivots relative to the outer arm about a pivot shaft axis, the inner arm having a first side which faces toward the first wall and a second side which faces toward the second wall; a first lost motion spring having a first lost motion spring outer arm tang grounded to the outer arm and a first lost motion spring inner arm tang grounded to the inner arm, the first lost motion spring biasing the inner arm to pivot relative to the outer arm in a first direction about the pivot shaft axis; a second lost motion spring having a second lost motion spring outer arm tang grounded to the outer arm and a second lost motion spring inner arm tang grounded to the inner arm, the second lost motion spring biasing the inner arm to pivot relative to the outer arm in the first direction about the pivot shaft axis; a lock pin which moves between 1) a coupled position in which the lock pin prevents the inner arm from pivoting about the pivot shaft axis relative to the outer arm past a predetermined position of the inner arm relative to the outer arm in a second direction which is opposite of the first direction and 2) a decoupled position in which the lock pin permits the inner arm to pivot relative to the outer arm past the predetermined position in the second direction about the pivot shaft axis; a roller shaft supported by the inner arm, wherein the roller shaft extends from the first side of the inner arm toward the first wall of the outer arm and also extends from the second side of the inner arm toward the second wall of the outer arm, the roller shaft being centered about, and extending along, a roller shaft axis which is parallel to the pivot shaft axis; a first roller carried by the roller shaft and rotatable about the roller shaft axis such that the first roller is configured to follow the camshaft, the first roller being located between the first side of the inner arm and the first wall of the outer arm; a second roller carried by the roller shaft and rotatable about the roller shaft axis such that the second roller is configured to follow the camshaft, the second roller being located between the second side of the inner arm and the second wall of the outer arm; a first roller retainer carried by the roller shaft and located between the first roller and the first wall of the outer arm, the first roller retainer having a first roller retainer surface with which the first lost motion spring inner arm tang is engaged to ground the first lost motion spring to the inner arm through the roller shaft; and a second roller retainer carried by the roller shaft and located between the second roller and the second wall of the outer arm, the second roller retainer having a second roller retainer surface with which the second lost motion spring inner arm tang is engaged to ground the second lost motion spring to the inner arm through the roller shaft.

Also briefly described, and in accordance with the present invention, a rocker arm for transmitting rotational motion from a camshaft to opening and closing motion of a combustion valve in an internal combustion engine includes an outer arm having a first wall and a second wall spaced apart from the second; an inner arm which selectively pivots relative to the outer arm about a pivot shaft axis; a lost motion spring having a lost motion spring outer arm tang grounded to the outer arm and a lost motion spring inner arm tang grounded to the inner arm, the lost motion spring biasing the inner arm to pivot relative to the outer arm in a first direction about the pivot shaft axis; a lock pin which moves between 1) a coupled position in which the lock pin prevents the inner arm from pivoting about the pivot shaft axis relative to the outer arm past a predetermined position of the inner arm relative to the outer arm in a second direction which is opposite of the first direction and 2) a decoupled position in which the lock pin permits the inner arm to pivot relative to the outer arm past the predetermined position in the second direction about the pivot shaft axis; a roller shaft supported by the inner arm, wherein the roller shaft extends toward the first wall of the outer arm, the roller shaft being centered about, and extending along, a roller shaft axis; a roller carried by the roller shaft and rotatable about the roller shaft axis such that the roller is configured to follow the camshaft; and a roller retainer carried by the roller shaft and located between the roller and the first wall of the outer arm, the roller retainer having a roller retainer surface with which the lost motion spring inner arm tang is engaged to ground the lost motion spring to the inner arm through the roller shaft.

Also briefly described, and in accordance with the present invention, a rocker arm for transmitting rotational motion from a camshaft to opening and closing motion of a combustion valve in an internal combustion engine includes an outer arm having a first wall and a second wall spaced apart from the second wall such that a central opening is provided between the first wall and the second wall, the first wall having a first spring shaft aperture extending therethrough and the second wall having a second spring shaft aperture extending therethrough; an inner arm which selectively pivots relative to the outer arm about a pivot shaft axis, the inner arm having a first side which faces toward the first wall and a second side which faces toward the second wall; a first lost motion spring having a plurality of coils, thereby defining a first lost motion spring aperture, the first lost motion spring also having a first lost motion spring outer arm tang grounded to the outer arm and a first lost motion spring inner arm tang grounded to the inner arm, the first lost motion spring biasing the inner arm to pivot relative to the outer arm in a first direction about the pivot shaft axis; a second lost motion spring having a plurality of coils, thereby defining a second lost motion spring aperture, the second lost motion spring also having a second lost motion spring outer arm tang grounded to the outer arm and a second lost motion spring inner arm tang grounded to the inner arm, the second lost motion spring biasing the inner arm to pivot relative to the outer arm in the first direction about the pivot shaft axis; a lock pin which moves between 1) a coupled position in which the lock pin prevents the inner arm from pivoting about the pivot shaft axis relative to the outer arm past a predetermined position of the inner arm relative to the outer arm in a second direction which is opposite of the first direction and 2) a decoupled position in which the lock pin permits the inner arm to pivot relative to the outer arm past the predetermined position in the second direction about the pivot shaft axis; a roller shaft supported by the inner arm, wherein the roller shaft extends from the first side of the inner arm toward the first wall of the outer arm and also extends from the second side of the inner arm toward the second wall of the outer arm, the roller shaft being centered about, and extending along, a roller shaft axis which is parallel to the pivot shaft axis; a first roller carried by the roller shaft and rotatable about the roller shaft axis such that the first roller is configured to follow the camshaft, the first roller being located between the first side of the inner arm and the first wall of the outer arm; a second roller carried by the roller shaft and rotatable about the roller shaft axis such that the second roller is configured to follow the camshaft, the second roller being located between the second side of the inner arm and the second wall of the outer arm; and a spring shaft supported by the outer arm such that the spring shaft is located within the first spring shaft aperture and the second spring shaft aperture and such that the spring shaft passes through the first lost motion spring aperture and through the second lost motion spring aperture.

The rocker arm described herein allows for compactness and ease of assembly as will be more readily apparent from a thorough reading of the following description.

BRIEF DESCRIPTION OF DRAWINGS

This invention will be further described with reference to the accompanying drawings in which.

DETAILED DESCRIPTION OF INVENTION

Figure 1:
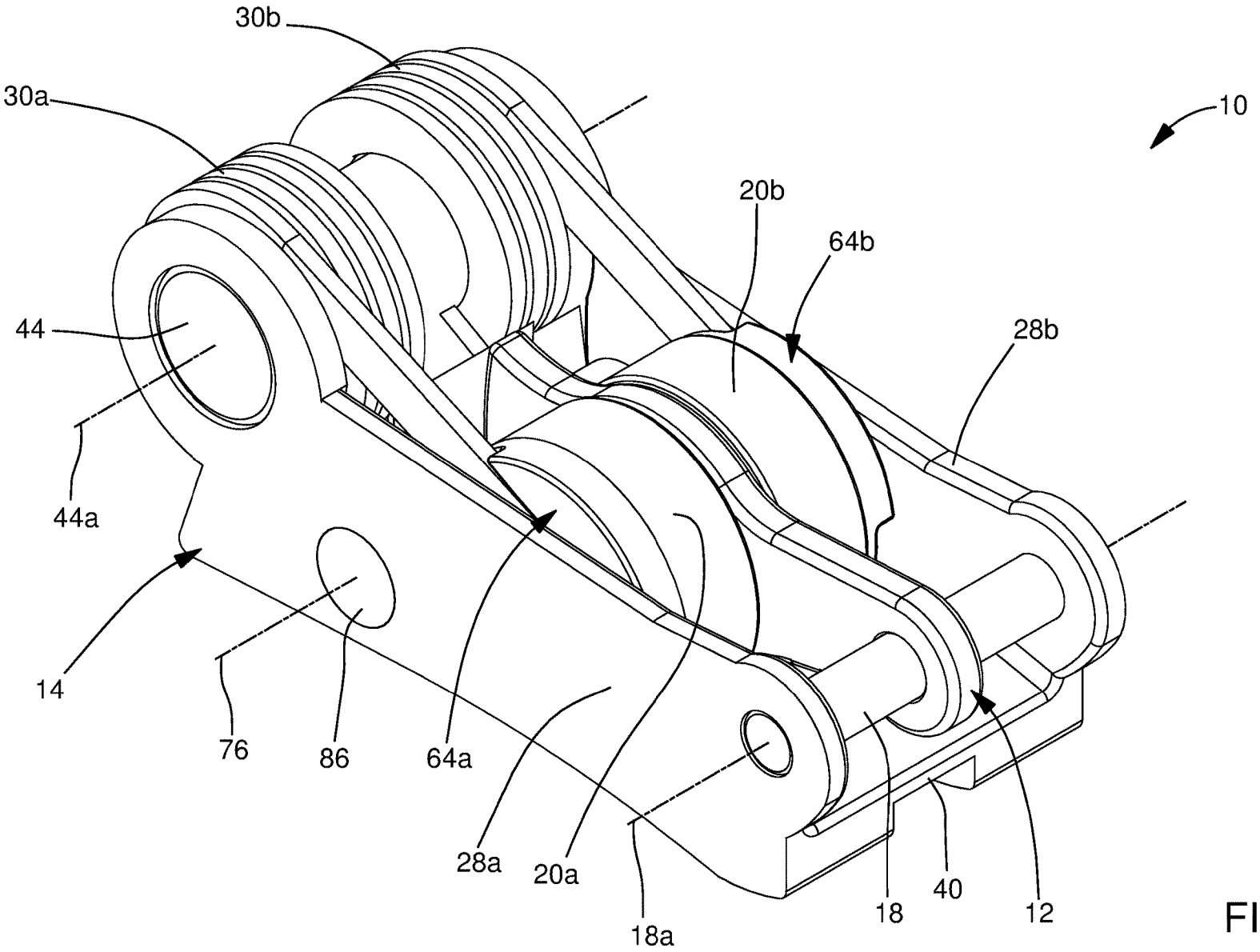
FIG. 1 is an isometric view of a rocker arm in accordance with the present invention.
Figure 2:
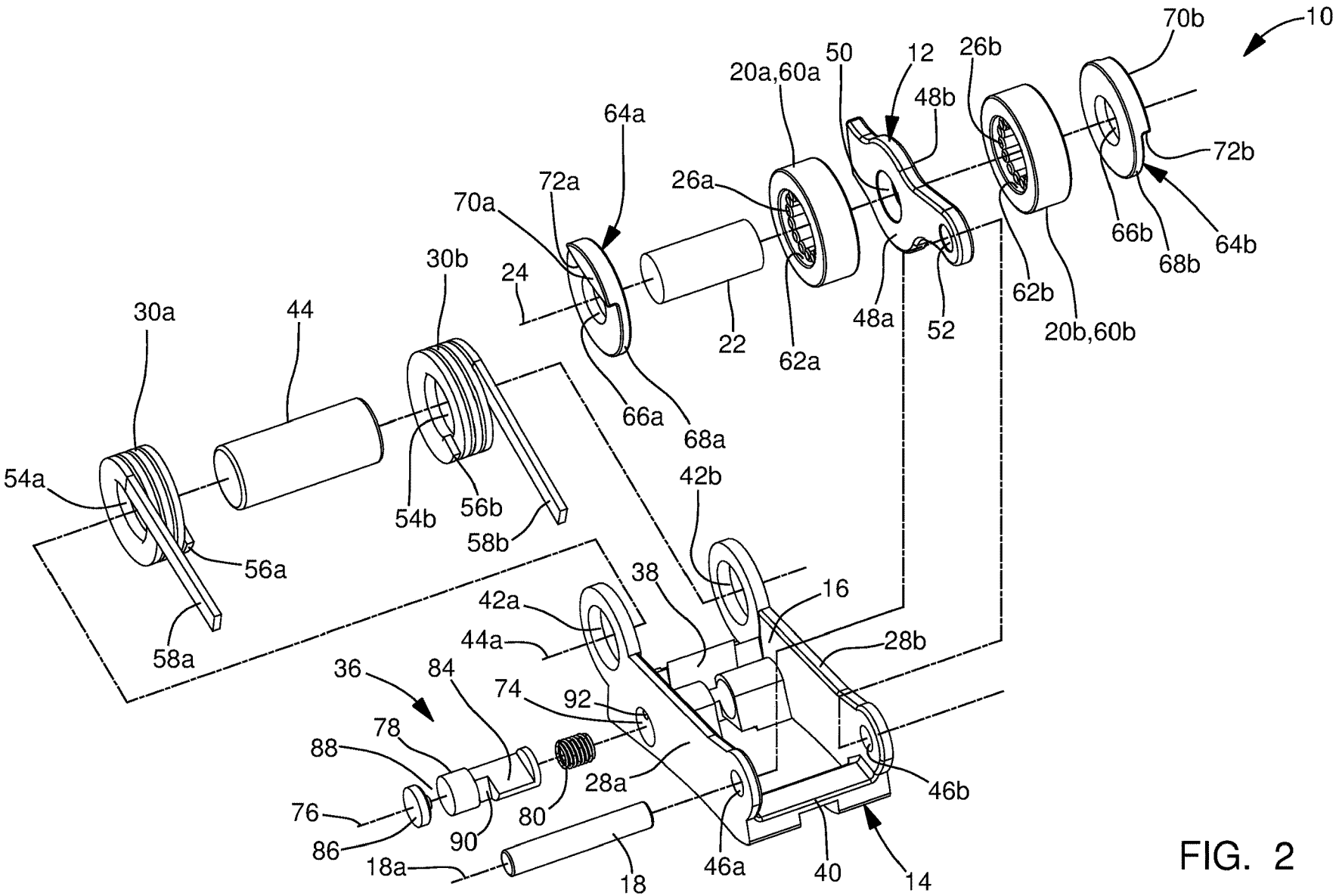
FIG. 2 is an exploded isometric view of the rocker arm of FIG. 1.

Referring to the figures, a rocker arm 10 in accordance with the invention is illustrated where rocker arm 10 is presented for illustrative purposes as a deactivation rocker arm but may alternatively be a two-step rocker arm, both of which may generically be referred to as a switchable rocker arm. Rocker arm 10 is included in valve train (not shown) of an internal combustion engine (not shown) in order to translate rotational motion of a camshaft 11 about a camshaft axis 11*a* to reciprocating motion of a combustion valve (not shown). As is known in the art of combustion valve actuation, camshaft 11 includes a base circle 11*b* which is centered about camshaft axis 11*a* and a lifting portion 11*c* which is eccentric to camshaft axis 11*a*. In this way, base circle 11*b* does not induce movement on the combustion valve while lifting portion 11*c* opens and closes the combustion valve. Rocker arm 10 includes an inner arm 12 that is pivotably disposed in a central opening 16 in an outer arm 14. Inner arm 12 selectively pivots within outer arm 14 on a pivot shaft 18 about a pivot shaft axis 18*a* such that pivot shaft 18 extends along, and is centered about, pivot shaft axis 18*a*. Inner arm 12 carries or supports a pair of followers illustrated as a first roller 20*a* and a second roller 20*b* carried by a roller shaft 22 that is supported by inner arm 12 such that first roller 20*a*, second roller 20*b*, and roller shaft 22 are each centered about, and extend along, a roller shaft axis 24. First roller 20*a* and second roller 20*b* are configured to follow base circle 11*b* and lifting portion 11*c*, to selectively impart lifting motion on a respective combustion valve. First roller 20*a* and second roller 20*b* are each cylindrical and tubular as shown. A plurality of first bearings 26*a* may rotatably support first roller 20*a* on roller shaft 22 for following base circle 11*b* and lifting portion 11*c* of camshaft 11 while a plurality of second bearings 26*b* may rotatably support second roller 20*b* on roller shaft 22 for following base circle 11*b* and lifting portion 11*c* of camshaft 11. First bearings 26*a* and second bearings 26*b* may be, for example, a plurality of rollers or needle bearings. Outer arm 14 includes a first wall 28*a* and a second wall 28*b* which are parallel to each other such that first wall 28*a* and second wall 28*b* are perpendicular to roller shaft axis 24 and such that first wall 28*a* and second wall 28*b* are spaced apart from each other in the direction of roller shaft axis 24 to define central opening 16 therebetween. A first lost motion spring 30*a* and a second lost motion spring 30*b* each act between inner arm 12 and outer arm 14 to pivot inner arm 12 away from outer arm 14 in a first direction, shown as clockwise as viewed in FIGS. 3 and 4, about pivot shaft axis 18*a*. A socket 32 for pivotably mounting rocker arm 10 on a lash adjuster (not shown) is included at a first end 14*a* of outer arm 14 while a pad 34 for actuating a valve stem (not shown) is proximal to a second end 14*b* of outer arm 14. A latching arrangement 36 disposed within outer arm 14 proximal to first end 14*a* thereof selectively permits inner arm 12 to pivot relative to outer arm 14 about pivot shaft axis 18*a* and also selectively prevents inner arm 12 from pivoting relative to outer arm 14 about pivot shaft axis 18*a* in a second direction, illustrated as counterclockwise as viewed in FIGS. 3 and 4, which is opposite of the first direction. While outer arm 14 has been illustrated herein as not including followers which follow respective profiles of camshaft 11, it should be understood that outer arm 14 may include followers such as rollers as shown in U.S. Pat. No. 7,305,951 or such as sliding surfaces as shown in U.S. Pat. No. 7,882,814 to Spath et al. and U.S. Pat. No. 6,668,779 to Hendriksma et al., the disclosures of each of which are hereby incorporated by reference in their entirety. When included, the followers of the outer arms are utilized to follow a profile of camshaft 11 which is a circle in the case of rocker arm 10 being a deactivation rocker arm and the followers of the outer arm are utilized to follow a profile of camshaft 11 which includes an eccentric portion similar to lifting portion 11*c* which provides a different magnitude or duration of lifting motion to rocker arm 10 in the case of rocker arm 10 being a two-step rocker arm.

Outer arm 14 includes an outer arm body 38 at first end 14*a* and an outer arm bridge 40 at second end 14*b*. Outer arm body 38 joints first wall 28*a* and second wall 28*b* at first end 14*a* and also defines socket 32 therein. Similarly, outer arm bridge 40 joins first wall 28*a* and second wall 28*b* at second end 14*b* and also defines pad 34 thereon. First wall 28*a*, second wall 28*b*, outer arm body 38, and outer arm bridge 40 may comprise a single piece of material which is formed, by way of non-limiting example, casting, forging, machining from solid, combinations thereof, and the like. Proximal to first end 14*a*, first wall 28*a* includes a first spring shaft aperture 42*a* extending therethrough and similarly, second wall 28*b* includes a second spring shaft aperture 42*b* extending therethrough, both of which receive a spring shaft 44 such that first spring shaft aperture 42*a*, second spring shaft aperture 42*b*, and spring shaft 44 are each centered about, and extend along, a spring shaft axis 44*a*. Spring shaft 44 interfaces with first spring shaft aperture 42*a* and second spring shaft aperture 42*b* in one of a close sliding interface and an interference fit which prevents radial movement of spring shaft 44 within first spring shaft aperture 42*a* and second spring shaft aperture 42*b*. Spring shaft 44 is fixed to outer arm 14, by way of non-limiting example only, with one or more of interference fit between spring shaft 44 and first spring shaft aperture 42*a* and second spring shaft aperture 42*b*, welding, and staking. Proximal to second end 14*b*, first wall 28*a* also includes a first pivot shaft aperture 46*a* extending therethrough and similarly, second wall 28*b* includes a second pivot shaft aperture 46*b* extending therethrough. First pivot shaft aperture 46*a* and second pivot shaft aperture 46*b* are each centered about, and extend along, pivot shaft axis 18*a* and each receive a portion of pivot shaft 18 therein in order to support pivot shaft 18 by outer arm 14. Pivot shaft 18 interfaces with first pivot shaft aperture 46*a* and second pivot shaft aperture 46*b* in a close sliding interface or an interference fit which prevents radial movement of pivot shaft 18 within first pivot shaft aperture 46*a* and second pivot shaft aperture 46*b*. Pivot shaft 18 is fixed to outer arm 14, by way of non-limiting example only, with one or more of interference fit between pivot shaft 18 and first pivot shaft aperture 46*a* and second pivot shaft aperture 46*b*, welding, and staking.

Inner arm 12 may be planar as shown and includes an inner arm first side 48*a* which faces toward first wall 28*a* and also includes an inner arm second side 48*b* which is parallel to first side 48*a* and which faces toward second wall 28*b*. Inner arm 12 includes an inner arm roller shaft aperture 50 which extends therethrough from first side 48*a* to second side 48*b* such that inner arm roller shaft aperture 50 is centered about, and extends along, roller shaft axis 24. Roller shaft 22 extends through inner arm roller shaft aperture 50 such that roller shaft 22 and inner arm roller shaft aperture 50 are sized to interface in a close-slide fit or an interference fit such that roller shaft 22 is prevented from moving radially within inner arm roller shaft aperture 50. Roller shaft 22 extends from first side 48*a* toward first wall 28*a* of outer arm 14 and similarly, roller shaft 22 also extends from second side 48*b* toward second wall 28*b* of outer arm 14. Roller shaft 22 may be left unfixed within inner arm roller shaft aperture 50 in a close sliding fit, but, may alternatively be fixed to inner arm 12, by way of non-limiting example only, with one or more of interference fit between roller shaft 22 and inner arm roller shaft aperture 50 and welding. Inner arm 12 also includes an inner arm pivot shaft aperture 52 which extends therethrough from first side 48*a* to second side 48*b* such that inner arm pivot shaft aperture 52 is centered about, and extends along, pivot shaft axis 18*a*. Pivot shaft 18 extends through inner arm pivot shaft aperture 52 such that pivot shaft 18 and inner arm pivot shaft aperture 52 are sized to interface in a close-slide fit such that pivot shaft 18 is prevented from moving radially within inner arm pivot shaft aperture 52 while allowing inner arm 12 to pivot about pivot shaft 18.

First lost motion spring 30*a* and second lost motion spring 30*b* are each coil torsion springs which are located between first wall 28*a* and second wall 28*b*. First lost motion spring 30*a* includes a plurality of coils, thereby defining a first lost motion spring aperture 54*a* through which spring shaft 44 passes. Similarly, second lost motion spring 30*b* includes a plurality of coils, thereby defining a second lost motion spring aperture 54*b* through which spring shaft 44 passes. In this way, spring shaft 44 guides and retains first lost motion spring 30*a* and second lost motion spring 30*b* to outer arm 14 in use. First lost motion spring 30*a* includes a first lost motion spring outer arm tang 56*a* at one end thereof which is grounded to outer arm 14 at outer arm body 38 and also includes a first lost motion spring inner arm tang 58*a* at the other end thereof which is grounded to inner arm 12 as will be described in greater detail later. Similarly, second lost motion spring 30*b* includes a second lost motion spring outer arm tang 56*b* at one end thereof which is grounded to outer arm 14 at outer arm body 38 and also includes a second lost motion spring inner arm tang 58*b* at the other end thereof which is grounded to inner arm 12 as will be described in greater detail later.

First roller 20*a* and second roller 20*b* will now be described in greater detail. First roller 20*a* is cylindrical and hollow, thereby defining a first roller outer surface 60*a* which is cylindrical and centered about roller shaft axis 24 and also thereby defining a first roller inner surface 62*a* which is cylindrical and centered about roller shaft axis 24. First bearings 26*a* are located within, and ride upon, first roller inner surface 62*a* and the outer periphery of roller shaft 22, thereby rotatably supporting first roller 20*a* on roller shaft 22. Similarly, second roller 20*b* is cylindrical and hollow, thereby defining a second roller outer surface 60*b* which is cylindrical and centered about roller shaft axis 24 and also thereby defining a second roller inner surface 62*b* which is cylindrical and centered about roller shaft axis 24. Second bearings 26*b* are located within, and ride upon, second roller inner surface 62*b* and the outer periphery of roller shaft 22, thereby rotatably supporting second roller 20*b* on roller shaft 22.

Figure 5:
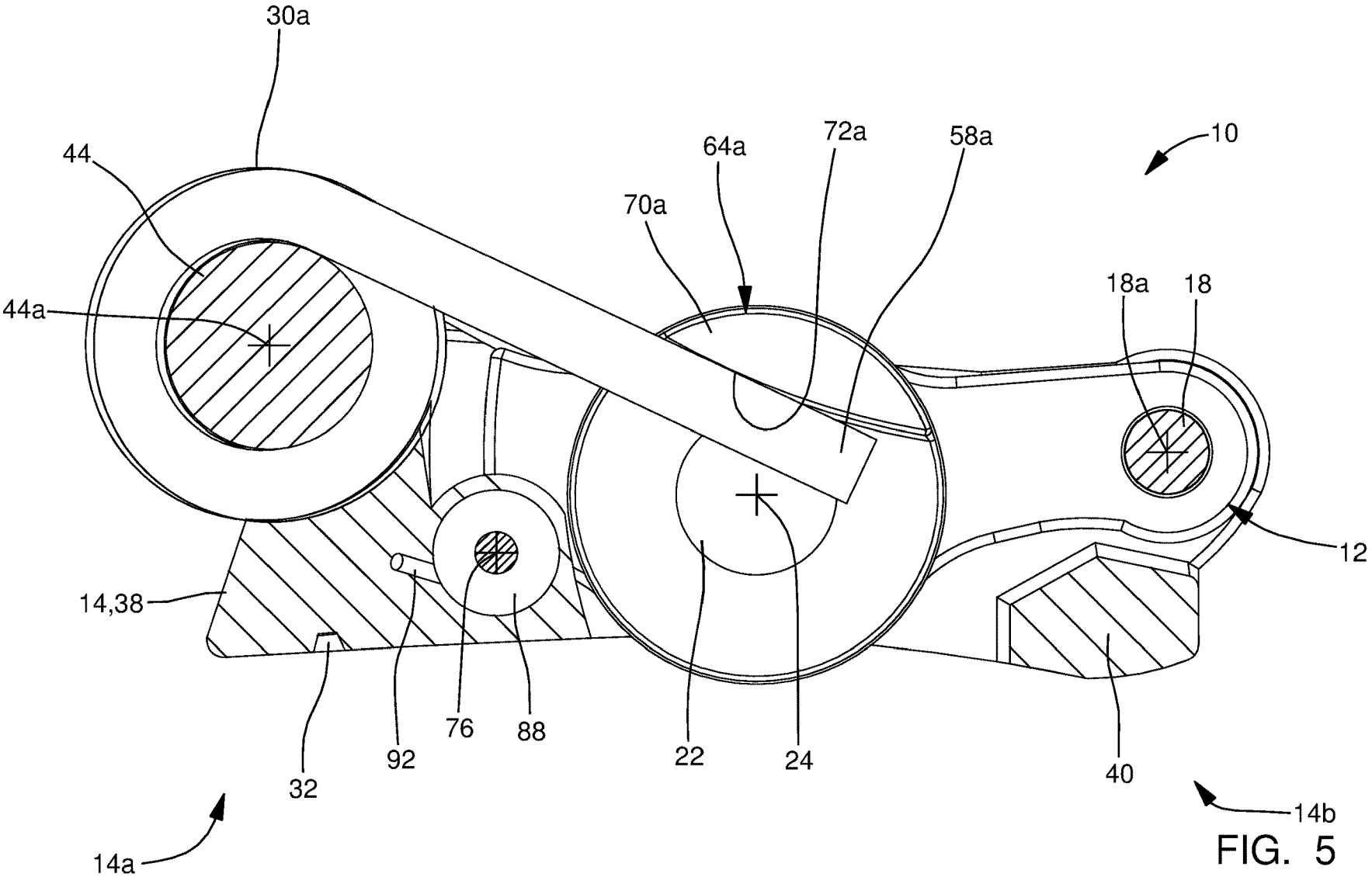
FIG. 5 is a cross-sectional view of the rocker arm of FIG. 1, taken through a plane that is parallel to the plane used to section FIG. 3 and showing a face-on view of a first roller retainer of the rocker arm.

A first roller retainer 64*a* is provided in order to retain first roller 20*a* and first bearings 26*a* and also in order to ground first lost motion spring inner arm tang 58*a* to inner arm 12 and similarly, a second roller retainer 64*b* is provided between second roller 20*b* and second wall 28*b* of outer arm 14 in order to retain second roller 20*b* and second bearings 26*b* and also in order to ground second lost motion spring inner arm tang 58*b* to inner arm 12. First roller retainer 64*a* includes a first roller retainer aperture 66*a* which extends therethrough such that first roller retainer aperture 66*a* is centered about, and extends along, roller shaft axis 24 and such that roller shaft 22 extends into first roller retainer aperture 66*a*. First roller retainer aperture 66*a* is sized to interface with roller shaft 22 in a close sliding fit such that radial movement of first roller retainer 64*a* relative to roller shaft 22 is prevented while allowing first roller retainer 64*a* to rotate freely about roller shaft axis 24 on roller shaft 22. In this way, first roller retainer 64*a* is carried by roller shaft 22. Alternatively, first roller retainer 64*a* may be fixed to roller shaft 22, for example, by interference fit or welding, thereby preventing first roller retainer 64*a* from rotating relative to roller shaft 22. First roller retainer 64*a* is annular in shape, thereby extending outward from first roller retainer aperture 66*a* to define a first roller retainer outer periphery 68*a* which surrounds roller shaft axis 24. First roller retainer outer periphery 68*a* is sized to cause first roller retainer 64*a* to be axially aligned, i.e. in the direction of roller shaft axis 24, with first bearings 26*a* and also to be axially aligned with first roller 20*a*, however, first roller retainer outer periphery 68*a* does not extend radially outward from roller shaft axis 24 to a greater extent than first roller outer surface 60*a* and second roller outer surface 60*b*. Consequently, first roller 20*a* and first bearings 26*a* are constrained axially between inner arm first side 48*a* and first roller retainer 64*a*. First roller retainer 64*a* includes a first roller retainer projection 70*a* extending axially, i.e. in the direction of roller shaft axis 24, toward first wall 28*a*. First roller retainer projection 70*a* includes a first roller retainer surface 72*a* which engages first lost motion spring inner arm tang 58*a* such that first lost motion spring inner arm tang 58*a* engages first roller retainer surface 72*a* to urge inner arm 12 to rotate about pivot shaft axis 18*a* in the first direction, i.e. clockwise as viewed in FIG. 5. In this way, first lost motion spring inner arm tang 58*a* is grounded to inner arm 12 through roller shaft 22. As shown in the figures, first roller retainer surface 72*a* may preferably be convex as viewed in the direction of roller shaft axis 24, i.e. as viewed in FIG. 5, or to be describe another way, in a plane that is perpendicular to roller shaft axis 24. In addition to, or in the alternative of first roller retainer surface 72*a* being convex, first lost motion spring inner arm tang 58*a* may be convex at the interface with first roller retainer surface 72*a*. In a further alternative, first roller retainer surface 72*a* may be concave if first lost motion spring inner arm tang 58*a* is convex at the interface with first roller retainer surface 72*a*. It is noted that first lost motion spring inner arm tang 58*a* is captured axially, i.e. in the direction of roller shaft axis 24, between first roller retainer 64*a* and first wall 28*a* of outer arm 14. Furthermore, first lost motion spring inner arm tang 58*a* is captured axially, i.e. in the direction of roller shaft axis 24, between roller shaft 22 and first wall 28*a* of outer arm 14.

Figure 6:
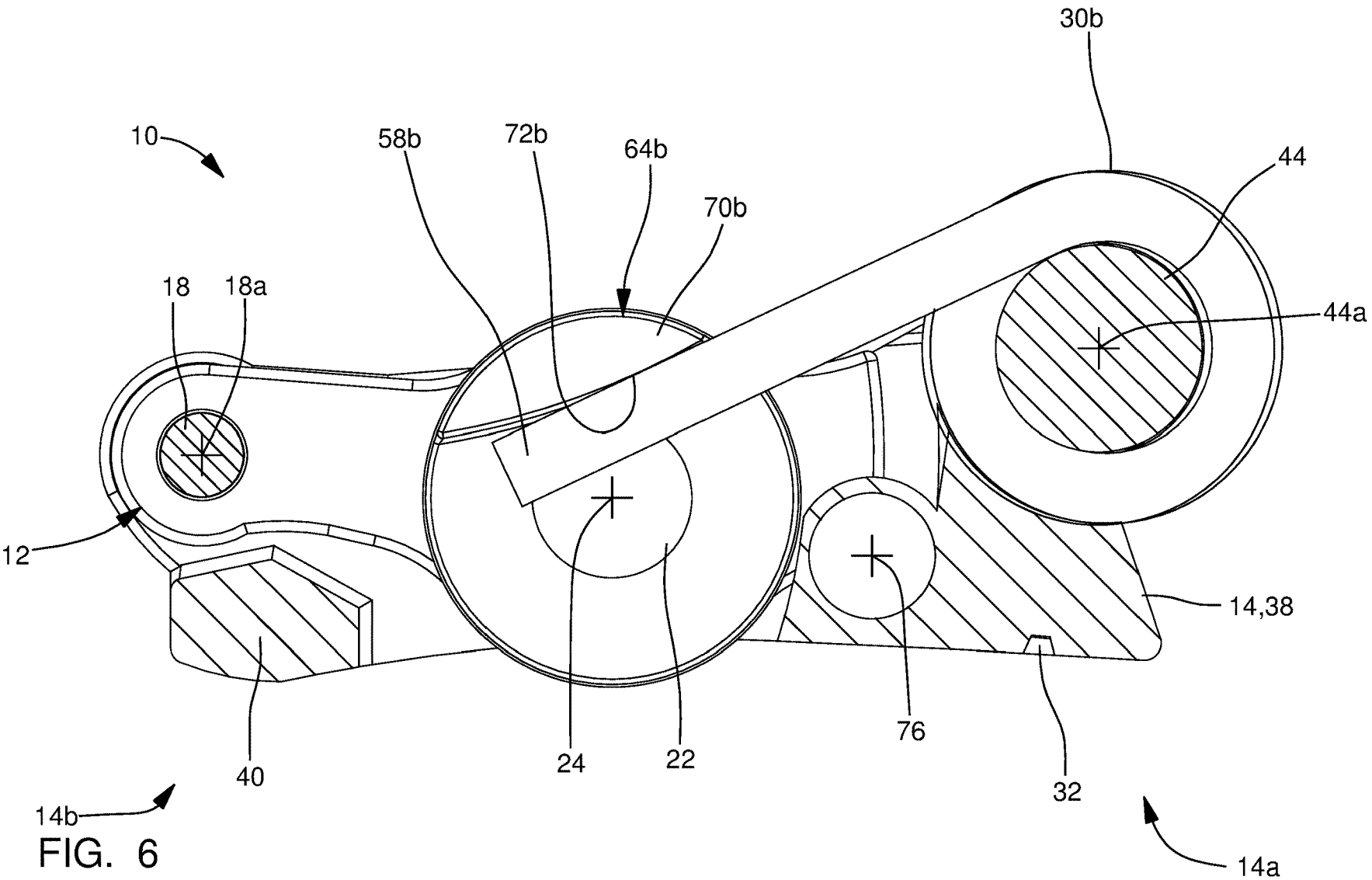
FIG. 6 is a cross-sectional view of the rocker arm of FIG. 1, taken through a plane that is parallel to the plane used to section FIG. 3, viewed in the opposite direction as FIG. 3, and showing a face-on view of a second roller retainer of the rocker arm.

Similar to first roller retainer 64*a*, second roller retainer 64*b* includes a second roller retainer aperture 66*b* which extends therethrough such that second roller retainer aperture 66*b* is centered about, and extends along, roller shaft axis 24 and such that roller shaft 22 extends into second roller retainer aperture 66*b*. Second roller retainer aperture 66*b* is sized to interface with roller shaft 22 in a close sliding fit such that radial movement of second roller retainer 64*b* relative to roller shaft 22 is prevented while allowing second roller retainer 64*b* to rotate freely about roller shaft axis 24 on roller shaft 22. In this way, second roller retainer 64*b* is carried by roller shaft 22. Alternatively, second roller retainer 64*b* may be fixed to roller shaft 22, for example, by interference fit or welding, thereby preventing second roller retainer 64*b* from rotating relative to roller shaft 22. Second roller retainer 64*b* is annular in shape, thereby extending outward from second roller retainer aperture 66*b* to define a second roller retainer outer periphery 68*b* which surrounds roller shaft axis 24. Second roller retainer outer periphery 68*b* is sized to cause second roller retainer 64*b* to be axially aligned, i.e. in the direction of roller shaft axis 24, with second bearings 26*b* and also to be axially aligned with second roller 20*b*, however, second roller retainer outer periphery 68*b* does not extend radially outward from roller shaft axis 24 to a greater extent than first roller outer surface 60*a* and second roller outer surface 60*b*. Consequently, second roller 20*b* and second bearings 26*b* are constrained axially between inner arm second side 48*a* and second roller retainer 64*b*. Second roller retainer 64*b* includes a second roller retainer projection 70*b* extending axially, i.e. in the direction of roller shaft axis 24, toward second wall 28*b*. Second roller retainer projection 70*b* includes a second roller retainer surface 72*b* which engages second lost motion spring inner arm tang 58*b* such that second lost motion spring inner arm tang 58*b* engages second roller retainer surface 72*b* to urge inner arm 12 to rotate about pivot shaft axis 18*a* in the second direction, i.e. clockwise as viewed in FIGS. 3-5 and counterclockwise as viewed in FIG. 6. In this way, second lost motion spring inner arm tang 58*b* is grounded to inner arm 12 through roller shaft 22. As shown in the figures, second roller retainer surface 72*b* may preferably be convex viewed in the direction of roller shaft axis 24, i.e. as viewed in FIG. 6, or to be describe another way, in a plane that is perpendicular to roller shaft axis 24. In addition to, or in the alternative of second roller retainer surface 72*b* being convex, second lost motion spring inner arm tang 58*b* may be convex at the interface with second roller retainer surface 72*b*. In a further alternative, second roller retainer surface 72*b* may be concave if second lost motion spring inner arm tang 58*b* is convex at the interface with second roller retainer surface 72*b*. It is noted that second lost motion spring inner arm tang 58*b* is captured axially, i.e. in the direction of roller shaft axis 24, between second roller retainer 64*b* and second wall 28*b* of outer arm 14. Furthermore, second lost motion spring inner arm tang 58*b* is captured axially, i.e. in the direction of roller shaft axis 24, between roller shaft 22 and second wall 28*b* of outer arm 14, and consequently, roller shaft 22 is captured axially between first lost motion spring inner arm tang 58*a* and second lost motion spring inner arm tang 58*b*.

Figure 3:
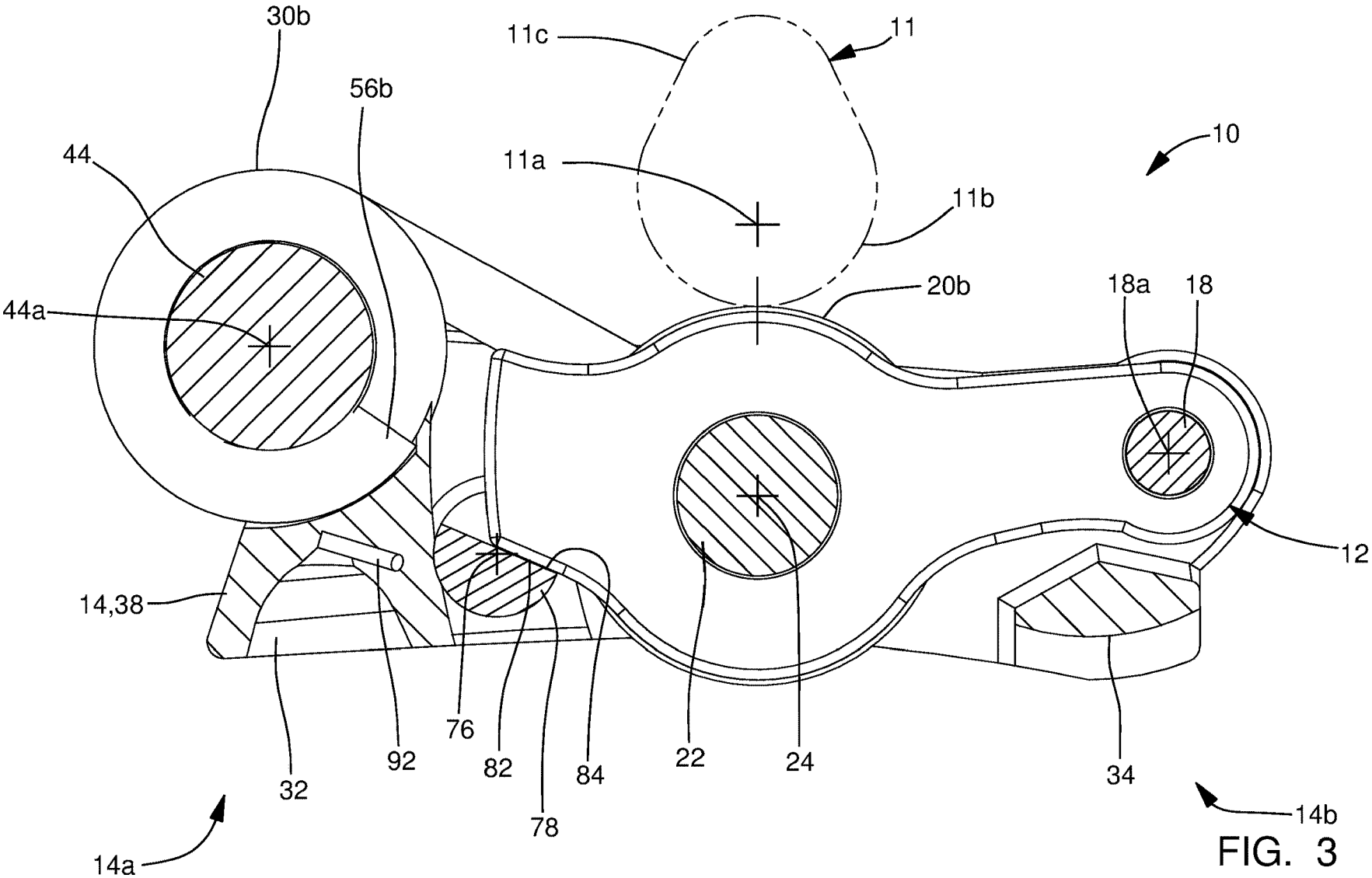
FIG. 3 is a cross-sectional view of the rocker arm of FIG. 1, taken through a plane that is perpendicular to an axis of rotation of rollers of an inner arm of the rocker arm, showing a latching arrangement of the rocker arm in a coupled state.
Figure 4:
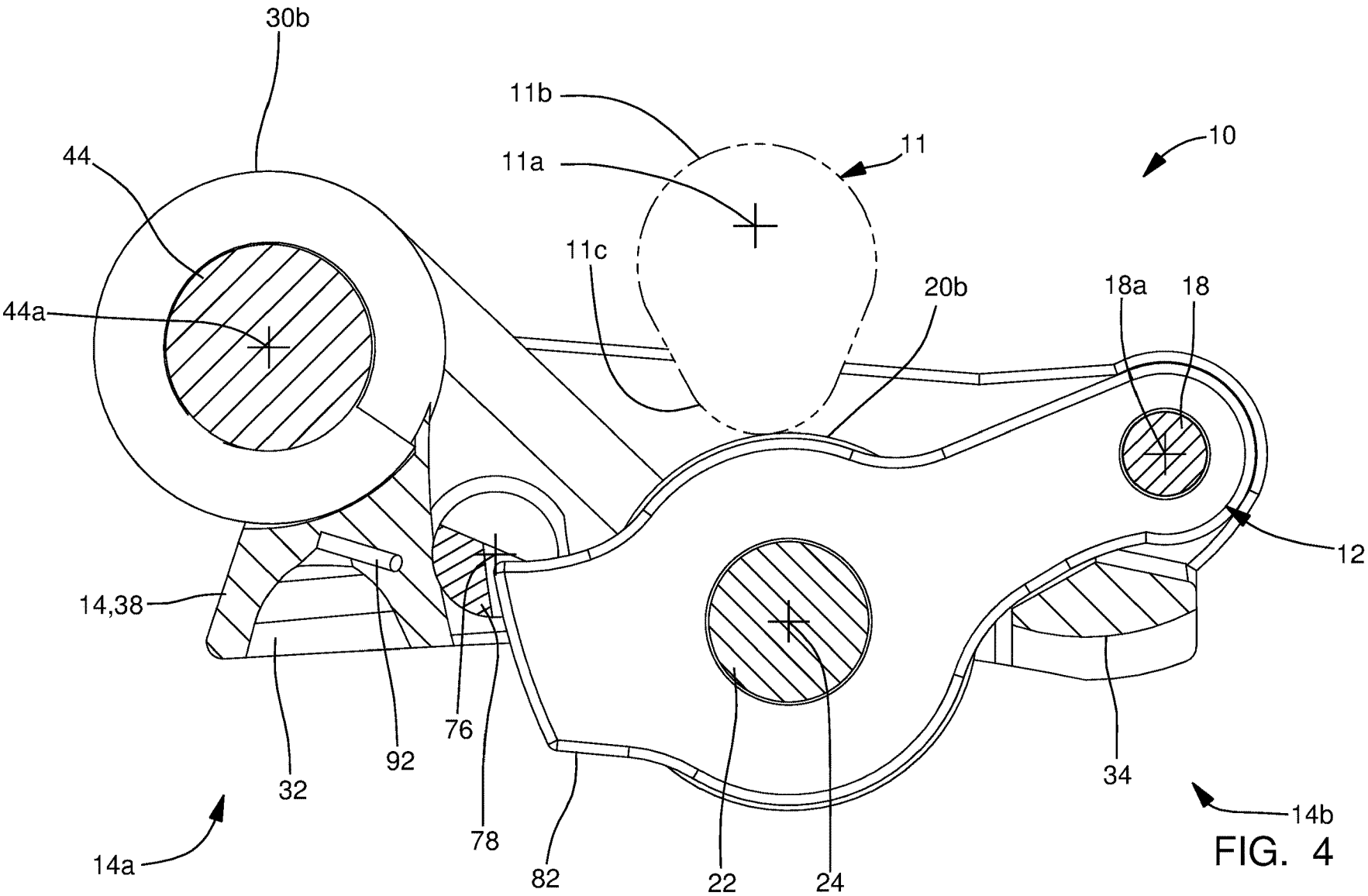
FIG. 4 is the cross-sectional view of FIG. 3, now showing the latching arrangement in a decoupled state.

Rocker arm 10 is selectively switched between a coupled state and a decoupled state by latching arrangement 36 which is actuated by application and venting of pressurized oil as will be described in greater detail later. In the coupled state as shown in FIG. 3, inner arm 12 is prevented from pivoting relative to outer arm 14 past a predetermined position of inner arm 12 relative to outer arm 14 in the second direction which is counterclockwise as viewed in FIG. 3. In this way, in the coupled state, inner arm 12, and therefore roller shaft 22, is coupled to outer arm 14, and rotation of lifting portion 11*c* is transferred from roller 20 through roller shaft 22 to pivotal movement of outer arm 14 about the lash adjuster which, in turn, reciprocates the associated valve. In the decoupled state as shown in FIG. 4, inner arm 12 is able to pivot relative to outer arm 14 past the predetermined position in the first direction. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12, together with first roller 20*a*, second roller 20*b*, and roller shaft 22, reciprocate within central opening 16, thereby compressing and uncompressing first lost motion spring 30*a* and second lost motion spring 30*b* in a cyclic manner such that first lost motion spring 30*a* and second lost motion spring 30*b* bias inner arm 12 to pivot relative to outer arm 14 in the first direction, shown as clockwise as viewed in FIG. 4.

Latching arrangement 36 will now be described in greater detail. Latching arrangement 36 includes a lock pin bore 74 which is centered about, and extends along, a lock pin bore axis 76 into outer arm body 38. As embodied herein, lock pin bore axis 76 may be parallel to pivot shaft axis 18*a*. Latching arrangement 36 also includes a lock pin 78 which is slidably disposed in lock pin bore 74. Lock pin 78 selectively engages inner arm 12 as shown in FIG. 3, thereby preventing inner arm 12 from pivoting relative to outer arm 14 in the second direction past the predetermined position. Lock pin 78 also selectively disengages inner arm 12 as shown in FIG. 4, thereby allowing inner arm 12 to pivot relative to outer arm 14 in the second direction past the predetermined position. Latching arrangement 36 also includes a lock pin spring 80 which urges lock pin 78 into engagement with inner arm 12 when desired, as shown in FIG. 3, to achieve the coupled state. Lock pin spring 80 is positioned in a blind end of lock pin bore 74 and consequently is grounded to outer arm 14. When lock pin 78 is moved to achieve the coupled state, an inner arm stop surface 82 of inner arm 12 is aligned with a lock pin stop surface 84 of lock pin 78, thereby preventing inner arm 12 from pivoting relative to outer arm 14 in the second direction past the predetermined position. Lock pin 78 is captured axially, i.e. in the direction of lock pin bore axis 76 by a lock pin retainer 86 which is fixed within lock pin bore 74, by way of non-limiting example only, by interference fit, welding, or mechanical fasteners. A pressure chamber 88 is defined axially between lock pin retainer 86 and lock pin 78 such that pressure chamber 88 selectively receives oil of sufficient pressure to urge lock pin 78 toward lock pin spring 80, thereby compressing lock pin spring 80 and moving lock pin stop surface 84 out of alignment with inner arm stop surface 82 and moving a lock pin slot 90 of lock pin 78 into alignment with inner arm stop surface 82. Lock pin slot 90 is sufficiently large to allow the portion of inner arm 12 which includes inner arm stop surface 82 to pass therethrough. Oil may be supplied to pressure chamber 88 through a rocker arm oil passage 92 which extends from socket 32 to pressure chamber 88 where the pressure of oil supplied to pressure chamber 88 may be controlled, for example, by an oil control valve (not shown) which receives oil from an oil supply (not shown) of the internal combustion engine.

While latching arrangement 36 has been illustrated herein as defaulting to the coupled position in the absence of hydraulic pressure, it should now be understood that latching arrangement 36 may alternatively be configured to default to the decoupled position in the absence of hydraulic pressure. This may be accomplished, for example, by reversing the direction which lock pin spring 80 acts upon lock pin 78. Furthermore, while latching arrangement 36 has been illustrated as being actuated based upon hydraulic pressure, other forms of actuation are anticipated, for example, by including a solenoid actuator which affects the position of lock pin 78 based on application of an electric current to the solenoid actuator. Also furthermore, while lock pin 46 has been described herein as being located within outer arm 14, it should be understood that lock pin 46 may alternatively be located within inner arm 12 and selectively engage a stop surface of outer arm 14.

Rocker arm 10 as described herein allows for compactness, particularly in the direction of roller shaft axis 24, which is important for packaging within the internal combustion engine. This compactness is achieved, at least in part, by inner arm 12 which is planar, thereby allowing inner arm 12 to be simply made, for example by stamping the desired shape from sheet metal. Rocker arm 10 also allows for ease of assembly, particularly with respect to the assembly of first roller 20*a*, second roller 20*b*, roller shaft 22, first roller retainer 64*a*, and second roller retainer 64*b* to inner arm 12. More particularly, each of these elements are captured between first lost motion spring inner arm tang 58*a* and second lost motion spring inner arm tang 58*b* and also between first wall 28*a* and second wall 28*b* such that these elements are axially constrained and maintained in an assembled relationship, thereby eliminating the need for additional retention which would require additional operations and/or materials.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm having a first wall and a second wall spaced apart from said first wall such that a central opening is provided between said first wall and said second wall;

an inner arm which selectively pivots relative to said outer arm about a pivot shaft axis, said inner arm having a first side which faces toward said first wall and a second side which faces toward said second wall;

a first lost motion spring having a first lost motion spring outer arm tang grounded to said outer arm and a first lost motion spring inner arm tang grounded to said inner arm, said first lost motion spring biasing said inner arm to pivot relative to said outer arm in a first direction about said pivot shaft axis;

a second lost motion spring having a second lost motion spring outer arm tang grounded to said outer arm and a second lost motion spring inner arm tang grounded to said inner arm, said second lost motion spring biasing said inner arm to pivot relative to said outer arm in said first direction about said pivot shaft axis;

a lock pin which moves between 1) a coupled position in which said lock pin prevents said inner arm from pivoting about said pivot shaft axis relative to said outer arm past a predetermined position of said inner arm relative to said outer arm in a second direction which is opposite said first direction and 2) a decoupled position in which said lock pin permits said inner arm to pivot relative to said outer arm past said predetermined position in said second direction about said pivot shaft axis;

a roller shaft supported by said inner arm, wherein said roller shaft extends from said first side of said inner arm toward said first wall of said outer arm and also extends from said second side of said inner arm toward said second wall of said outer arm, said roller shaft being centered about, and extending along, a roller shaft axis which is parallel to said pivot shaft axis;

a first roller carried by said roller shaft and rotatable about said roller shaft axis such that said first roller is configured to follow said camshaft, said first roller being located between said first side of said inner arm and said first wall of said outer arm;

a second roller carried by said roller shaft and rotatable about said roller shaft axis such that said second roller is configured to follow said camshaft, said second roller being located between said second side of said inner arm and said second wall of said outer arm;

a first roller retainer carried by said roller shaft and located between said first roller and said first wall of said outer arm, said first roller retainer having a first roller retainer surface with which said first lost motion spring inner arm tang is engaged to ground said first lost motion spring to said inner arm through said roller shaft; and a second roller retainer carried by said roller shaft and located between said second roller and said second wall of said outer arm, said second roller retainer having a second roller retainer surface with which said second lost motion spring inner arm tang is engaged to ground said second lost motion spring to said inner arm through said roller shaft wherein a first roller retainer aperture extends through said first roller retainer such that said roller shaft is located in said first roller retainer aperture; and wherein a second roller retainer aperture extends through said second roller retainer such that said roller shaft is located in said second roller retainer aperture.

2. A rocker arm as in claim 1, wherein:

said first roller retainer surface is convex as viewed in a direction of said roller shaft axis; and said second roller retainer surface is convex as viewed in the direction of said roller shaft axis.

3. A rocker arm as in claim 1, wherein:

a plurality of first bearings is provided radially between said roller shaft and said first roller such that said plurality of first bearings is captured axially between said first side of said inner arm and said first roller retainer; and a plurality of second bearings is provided radially between said roller shaft and said second roller such that said plurality of second bearings is captured axially between said second side of said inner arm and said second roller retainer.

4. A rocker arm as in claim 1, wherein said roller shaft is captured axially along said roller shaft axis between said first lost motion spring inner arm tang and said second lost motion spring inner arm tang.

5. A rocker arm as in claim 4, wherein:

said first lost motion spring inner arm tang is captured axially along said roller shaft axis between said roller shaft and said first wall of said outer arm; and said second lost motion spring inner arm tang is captured axially along said roller shaft axis between said roller shaft and said second wall of said outer arm.

6. A rocker arm as in claim 1, wherein:

said first lost motion spring inner arm tang is captured axially along said roller shaft axis between said roller shaft and said first wall of said outer arm; and said second lost motion spring inner arm tang is captured axially along said roller shaft axis between said roller shaft and said second wall of said outer arm.

7. A rocker arm as in claim 1, wherein:

a first roller retainer projection extends from said first roller retainer toward said first wall of said outer arm such that said first roller retainer surface is located on said first roller retainer projection; and a second roller retainer projection extends from said second roller retainer toward said second wall of said outer arm such that said second roller retainer surface is located on said second roller retainer projection.

8. A rocker arm as in claim 1, wherein:

a first spring shaft aperture extends through said first wall of said outer arm;

a second spring shaft aperture extends through said second wall of said outer arm;

said first lost motion spring includes a plurality of coils, thereby defining a first lost motion spring aperture;

said second lost motion spring includes a plurality of coils, thereby defining a second lost motion spring aperture; and said rocker arm further comprises a spring shaft supported by said outer arm such that said spring shaft is located within said first spring shaft aperture and said second spring shaft aperture and such that said spring shaft passes through said first lost motion spring aperture and through said second lost motion spring aperture.

9. A rocker arm as in claim 8, wherein:

said plurality of coils of said first lost motion spring is located between said first wall and said second wall of said outer arm; and said plurality of coils of said second lost motion spring is located between said first wall and said second wall of said outer arm.

10. A rocker arm for transmitting rotational motion from a camshaft to opening and closing motion of a combustion valve in an internal combustion engine, said rocker arm comprising:

an outer arm having a first wall and a second wall spaced apart from said first wall;

an inner arm which selectively pivots relative to said outer arm about a pivot shaft axis;

a lost motion spring having a lost motion spring outer arm tang grounded to said outer arm and a lost motion spring inner arm tang grounded to said inner arm, said lost motion spring biasing said inner arm to pivot relative to said outer arm in a first direction about said pivot shaft axis;

a lock pin which moves between 1) a coupled position in which said lock pin prevents said inner arm from pivoting about said pivot shaft axis relative to said outer arm past a predetermined position of said inner arm relative to said outer arm in a second direction which is opposite said first direction and 2) a decoupled position in which said lock pin permits said inner arm to pivot relative to said outer arm past said predetermined position in said second direction about said pivot shaft axis;

a roller shaft supported by said inner arm, wherein said roller shaft extends toward said first wall of said outer arm, said roller shaft being centered about, and extending along, a roller shaft axis;

a roller carried by said roller shaft and rotatable about said roller shaft axis such that said roller is configured to follow said camshaft; and a roller retainer carried by said roller shaft and located between said roller and said first wall of said outer arm, said roller retainer having a roller retainer surface with which said lost motion spring inner arm tang is engaged to ground said lost motion spring to said inner arm through said roller shaft wherein a roller retainer aperture extends through said roller retainer such that said roller shaft is located in said roller retainer aperture.

11. A rocker arm as in claim 10, wherein said roller retainer surface is convex as viewed in a direction of said roller shaft axis.

12. A rocker arm as in claim 10, wherein a plurality of bearings is provided radially between said roller shaft and said roller such that said plurality of bearings is captured axially between said inner arm and said roller retainer.

13. A rocker arm as in claim 10, wherein:

said lost motion spring inner arm tang is captured axially along said roller shaft axis between said roller shaft and said first wall of said outer arm.

14. A rocker arm as in claim 10, wherein:

a roller retainer projection extends from said roller retainer toward said first wall of said outer arm such that said roller retainer surface is located on said roller retainer projection.

15. A rocker arm as in claim 10, wherein:

a first spring shaft aperture extends through said first wall of said outer arm;

a second spring shaft aperture extends through said second wall of said outer arm;

said lost motion spring includes a plurality of coils, thereby defining a lost motion spring aperture; and said rocker arm further comprises a spring shaft supported by said outer arm such that said spring shaft is located within said first spring shaft aperture and said second spring shaft aperture and such that said spring shaft passes through said lost motion spring aperture.

16. A rocker arm as in claim 15, wherein:

said plurality of coils of said lost motion spring is located between said first wall and said second wall of said outer arm.

17. A rocker arm for transmitting rotational motion from a camshaft to opening and closing motion of a combustion valve in an internal combustion engine, said rocker arm comprising:

an outer arm having a first wall and a second wall spaced apart from said first wall such that a central opening is provided between said first wall and said second wall, a first spring shaft aperture extends through said first wall and a second spring shaft aperture extends through said second wall;

an inner arm which selectively pivots relative to said outer arm about a pivot shaft axis, said inner arm having a first side which faces toward said first wall and a second side which faces toward said second wall;

a first lost motion spring having a plurality of coils, thereby defining a first lost motion spring aperture, said first lost motion spring also having a first lost motion spring outer arm tang grounded to said outer arm and a first lost motion spring inner arm tang grounded to said inner arm, said first lost motion spring biasing said inner arm to pivot relative to said outer arm in a first direction about said pivot shaft axis;

a second lost motion spring having a plurality of coils, thereby defining a second lost motion spring aperture, said second lost motion spring also having a second lost motion spring outer arm tang grounded to said outer arm and a second lost motion spring inner arm tang grounded to said inner arm, said second lost motion spring biasing said inner arm to pivot relative to said outer arm in said first direction about said pivot shaft axis;

a lock pin which moves between 1) a coupled position in which said lock pin prevents said inner arm from pivoting about said pivot shaft axis relative to said outer arm past a predetermined position of said inner arm relative to said outer arm in a second direction which is opposite said first direction and 2) a decoupled position in which said lock pin permits said inner arm to pivot relative to said outer arm past said predetermined position in said second direction about said pivot shaft axis;

a roller shaft supported by said inner arm, wherein said roller shaft extends from said first side of said inner arm toward said first wall of said outer arm and also extends from said second side of said inner arm toward said second wall of said outer arm, said roller shaft being centered about, and extending along, a roller shaft axis which is parallel to said pivot shaft axis;

a first roller carried by said roller shaft and rotatable about said roller shaft axis such that said first roller is configured to follow said camshaft, said first roller being located between said first side of said inner arm and said first wall of said outer arm;

a second roller carried by said roller shaft and rotatable about said roller shaft axis such that said second roller is configured to follow said camshaft, said second roller being located between said second side of said inner arm and said second wall of said outer arm; and a spring shaft supported by said outer arm and extending along a spring shaft axis which is parallel to and laterally offset from said pivot shaft axis such that said spring shaft is located within said first spring shaft aperture and said second spring shaft aperture and such that said spring shaft passes through said first lost motion spring aperture and through said second lost motion spring aperture.

18. A rocker arm as in claim 17, wherein:

said plurality of coils of said first lost motion spring is located between said first wall and said second wall of said outer arm; and said plurality of coils of said second lost motion spring is located between said first wall and said second wall of said outer arm.

* * * * *